US006632385B2

(12) United States Patent
Kauschke et al.

(10) Patent No.: US 6,632,385 B2
(45) Date of Patent: Oct. 14, 2003

(54) CONDRAPABLE HYDROPHOBIC NONWOVEN WEB AND METHOD OF MAKING SAME

(75) Inventors: Michael Kauschke, Rimsting (DE); Mordechai Turi, Princeton Junction, NJ (US); Horst Ring, Boeblingen (DE); Sabine Borst, Waldenbuch (DE)

(73) Assignee: First Quality Nonwovens, Inc., State College, PA (US)

( * ) Notice: Subject to any disclaimer, the term of this patent is extended or adjusted under 35 U.S.C. 154(b) by 133 days.

(21) Appl. No.: 09/817,013

(22) Filed: Mar. 23, 2001

(65) Prior Publication Data

US 2002/0190424 A1 Dec. 19, 2002

(51) Int. Cl.[7] ..... D04H 3/02; D04H 3/10; D04H 3/16; D06M 15/643

(52) U.S. Cl. ..... 264/103; 264/129; 264/130; 264/211.13; 264/211.2; 264/234

(58) Field of Search ..... 264/103, 129, 264/130, 211.13, 211.2, 234

(56) References Cited

U.S. PATENT DOCUMENTS

| | | | | |
|---|---|---|---|---|
| 3,922,423 | A | | 11/1975 | Hoerster et al. |
| 3,973,068 | A | | 8/1976 | Weber |
| 4,070,218 | A | | 1/1978 | Weber |
| 4,237,155 | A | | 12/1980 | Kardouche |
| 4,335,003 | A | | 6/1982 | Nordschild |
| 4,437,860 | A | | 3/1984 | Sigl |
| 4,623,576 | A | | 11/1986 | Lloyd et al. |
| 4,838,885 | A | | 6/1989 | Bernardin |
| 4,925,722 | A | | 5/1990 | Jeffers |
| 5,045,387 | A | * | 9/1991 | Schmalz ..... 442/119 |
| 5,573,719 | A | | 11/1996 | Fitting |
| 5,599,366 | A | | 2/1997 | Hassenboehler, Jr |
| 5,620,788 | A | | 4/1997 | Garavaglia |
| 5,635,128 | A | | 6/1997 | Gardiner et al. |
| 5,696,191 | A | | 12/1997 | Nohr et al. |
| 5,811,482 | A | | 9/1998 | Sabia |
| 5,952,274 | A | | 9/1999 | Rieckert et al. |
| 5,958,806 | A | | 9/1999 | Jensen |
| 5,972,497 | A | | 10/1999 | Hirwe |
| 5,998,023 | A | | 12/1999 | Turkevich et al. |
| 6,008,145 | A | | 12/1999 | Dzen |
| 6,017,832 | A | | 1/2000 | Yahiaoui et al. |
| 6,028,016 | A | | 2/2000 | Yahiaoui et al. |
| 6,042,615 | A | | 3/2000 | Habereder |
| 6,049,024 | A | | 4/2000 | Thomas et al. |
| 6,080,686 | A | | 6/2000 | Floyd |
| 6,080,818 | A | | 6/2000 | Thakker et al. |
| 6,083,856 | A | | 7/2000 | Joseph et al. |
| 6,114,419 | A | | 9/2000 | Liss et al. |
| 6,139,941 | A | | 10/2000 | Jankevics |
| 6,150,020 | A | | 11/2000 | Dharmadhikary |
| 6,153,701 | A | | 11/2000 | Potnis |

FOREIGN PATENT DOCUMENTS

| | | |
|---|---|---|
| WO | WO 96/23915 A2 | 8/1996 |

* cited by examiner

*Primary Examiner*—Leo B. Tentoni
(74) *Attorney, Agent, or Firm*—Amster, Rothstein & Ebenstein

(57) ABSTRACT

A condrapable hydrophobic nonwoven web of continuous fibers includes a hydrophobic nonwoven web of continuous fibers, and a fiber surface-modifying agent on the web to form therewith a condrapable hydrophobic web. The agent is essentially an amino-modified polydimethylsiloxane. The condrapable hydrophobic web is characterized by a substantial hydrophobicity, as measured by a strike-through of over 180 seconds and by a substantial increase in condrapability, as measured by a Handle-O-Meter decrease of at least 15% average for MD and CD.

60 Claims, No Drawings

CONDRAPABLE HYDROPHOBIC NONWOVEN WEB AND METHOD OF MAKING SAME

BACKGROUND OF THE INVENTION

The present invention relates to a condrapable hydrophobic nonwoven web of continuous fibers and a method of making the same, and more particularly to a method of making the same using a fiber surface-modifying agent.

Nonwoven webs of continuous fibers are well-known in the fabric art and are commonly known as "meltspuns," a term derived from the primary members of the class—namely, meltblowns, spunbonds and combinations thereof. While other nonwoven webs are known in the art, they contain staple fibers (that is, short fibers rather than continuous fibers), carded webs being a well-known example of such nonwoven webs of non-continuous fibers.

The meltspun webs have utility in a wide variety of different applications. Some of these applications—for example, use as diaper back sheets and cuffs—arise out of the hydrophobic nature and barrier properties of the meltspun web due to the nature of the material used in the web. For example, a web formed of polypropylene fibers typically exhibits the high degree of hydrophobicity required for use in diaper back sheets and cuffs, surgical gowns and the like where water absorption by the fabric formed from the continuous fibers would be undesirable, but exhibits an inferior hand and drape. On the other hand, meltspun webs formed of other materials, such as polyethylene and polyethylene/polypropylene copolymers, either exhibit an unsatisfactorily lower level of hydrophobicity for particular applications or are even hydrophilic in nature, but exhibit superior relative softness and drape. In this instance, the materials may be rendered hydrophobic or more hydrophobic by the use of a hydrophobic material such as polydimethylsiloxane (hereinafter "PDMS"). The PDMS may either be incorporated into the polymer mix from which the fibers are made or applied to the web after web formation.

An economic application of particular web additives to a web is typically achieved by dispersing the additive in an aqueous medium so that the additive-containing aqueous medium may thereafter be conveniently sprayed, coated, or otherwise applied to the web, with the aqueous medium thereafter being removed from the web by simple drying in order to leave the additive on the fiber surfaces of the web. Some of these additives are hydrophilic in nature and thus easily dispersed in the aqueous medium. Others are hydrophobic and thus require the use of a hydrophilic emulsifier (such as long chain fatty acids) in order to disperse the additive in the aqueous medium. In the latter instance, removal of the aqueous medium leaves not only the desired additive on the fibers, but also the hydrophilic emulsifier so that the treated web is either hydrophilic or at least less hydrophobic than it would have been prior to treatment with the additive. Exemplary of the additives are the surfactants and lubricants commonly used to enhance the aesthetic tactile properties, such as softness, smoothness and feel. Use of a surfactant to provide softening of the web lessens the hydrophobic nature of the web and, indeed, often produces a hydrophilic product unacceptable for particular applications requiring a hydrophobic nature. See, for example, U.S. Pat. No. 3,973,068.

Speaking more particularly, it is known to provide a hydrophobic nonwoven web of continuous fibers formed of polypropylene. It is known to apply to the fibers of such a web, as a softener or lubricant, a hydrophilic additive dispersed in an aqueous medium (to facilitate economical application of the additive onto the web) and then to dry the web to remove the aqueous medium and leave a treated web. However, the treated web thus produced is typically no longer sufficiently hydrophobic for its intended use either because the additive with which it was treated is itself primarily hydrophilic or because a quantity of hydrophilic emulsifier was used to disperse a non-hydrophilic additive in the aqueous medium.

Accordingly, it is an object of the present invention to provide a method of making a condrapable hydrophobic nonwoven web of continuous fibers.

Another object is to provide such a method using as an additive a fiber surface-modifying agent dispersed in an aqueous medium where the web retains its essentially hydrophobic nature.

A further object is to provide such a method wherein the agent is dispersed in the aqueous medium using a hydrophilic emulsifier in a quantity such that it does not adversely affect the hydrophobic nature of the web.

It is also an object of the present invention to provide products made by the method.

SUMMARY OF THE INVENTION

It has now been found that the above and related objects of the present invention are obtained in a method of making a condrapable hydrophobic nonwoven web of continuous fibers having an initial condrapability, comprising the steps of providing a hydrophobic nonwoven web of continuous fibers and applying to the web a fiber surface-modifying agent dispersed in an aqueous medium. Finally, the web is dried to remove the aqueous medium and leave a condrapable hydrophobic web. In one aspect of the invention, the agent essentially comprises an amino-modified polydimethylsiloxane. In another aspect of the invention, the dried web is characterized by a substantial hydrophobicity, as measured by a strike-through of over 300 seconds, and by a substantial improvement in condrapability, as measured by a Handle-O-Meter decrease (in the force measured) of at least 15% (and preferably at least 20%) average for MD and CD.

Preferably, the web is a meltspun nonwoven.

In a preferred embodiment, the amino-modification is the substitution of an aminoalkyl group for a methyl group of PDMS. Thus, the amino-modified PDMS is

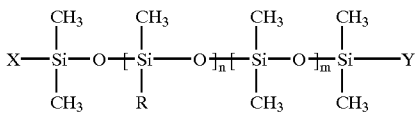

where independently Y, X=a termination group;

$R=R_1—NH—R_2$;

$R_1=—(CH_2)p—$, where p=greater than zero;

$R_2$=hydrogen, alkyl, cycloalkyl, aryl, aminoalkyl, alkylaminoalkyl, cycloalkylaminoalkyl, or aminoaryl; and independently n, m=greater than zero.

Preferably, $$R=CH_2—CH_2—CH_2—NH—R_2$$

In a preferred amino-modified PDMS, the combined n+m is 400 to 1,500 (preferably about 1,100); the degree of amino modification is 2 to 5 (preferably about 3.5); and the amino number is 0.1 to 0.3 (preferably about 0.12–0.15). The molecular weight of the amino-modified PDMS, at the time of application to the web, is about 30,000 to 150,000 (preferably 70,000–100,000).

The wet pick-up of the web is 20 to 200% based on the dry web; the aqueous medium has 0.5 to 20% agent therein, based on the weight of the aqueous medium; and the dried web has 0.005 to 0.5% agent thereon, based on the weight of the dried web.

The fibers are selected from the group consisting of polyolefins, polyesters, polyamides, copolymers thereof and blends thereof. Preferably the fibers are polyolefins selected from the group consisting of polyethylene, polypropylene, copolymers thereof and blends thereof. Optimally, the fibers are polypropylene. The fibers are consolidated by a process selected from the group consisting of thermal bonding (fusion bonding), chemical bonding (resin bonding), hydroentanglement and needle punch, preferably by a thermal bonding process.

The agent may be dispersed in the aqueous medium by at least one hydrophilic emulsifier. Preferably the hydrophilic emulsifier is nonionic, and optimally it is at least one ethoxylated fatty alcohol. The hydrophilic emulsifier has an HLB of 8 to 17 and is present at 3 to 30%, based on the weight of the agent. The hydrophilic emulsifier may include a nonionic or cationic co-emulsifier.

The present invention also encompasses a condrapable hydrophobic nonwoven web of continuous fibers, comprising a hydrophobic nonwoven web of continuous fibers, and a fiber surface-modifying agent on the web to form therewith a condrapable hydrophobic web. The agent essentially comprises an amino-modified polydimethylsiloxane, and the condrapable hydrophobic web is characterized by a substantial hydrophobicity, as measured by a strike-through over 180 seconds, and by a substantial improvement in condrapability, as measured by a Handle-O-Meter decrease of at least 15% average for MD and CD relative to the initial condrapability.

DETAILED DESCRIPTION OF THE PREFERRED EMBODIMENTS

Briefly, the present invention is a condrapable hydrophobic nonwoven web of continuous fibers, and a method of making the same. The method involves the steps of providing a hydrophobic nonwoven web of continuous fibers, applying to the web a fiber surface-modifying agent dispersed in an aqueous medium, and then drying the web to remove the aqueous medium and leave a condrapable hydrophobic web (containing the agent). Thus, the fiber surface-modifying agent must be capable of improving the initial condrapability of the web, while still leaving the web hydrophobic. It has been found that an amino-modified polydimethylsiloxane maintains and may even improve the desired hydrophobicity of the web due to its highly hydrophobic PDMS nature, while at the same time it renders the web more condrapable due to the amino-modification. The agent is sufficiently hydrophobic in nature that, even when it is necessary to use a hydrophilic emulsifier in order to disperse the agent in an aqueous medium, the essentially hydrophobic nature of the agent prevails and maintains the web hydrophobic, notwithstanding the presence of the hydrophilic emulsifier.

The term "hydrophobicity" designates an attribute related to three distinct and quantifiable parameters: hydrohead (EDANA 120.1-80 for Hydrostatic Head), strike-through (EDANA 1503-96 for Strike-Through Time or Acquisition Speed), and contact angle (FIBRO DAT (Dynamic Absorption Tester—Version 2.6) 1100). Depending upon the context in which the term is used in the prior art and the particular applications of the hydrophobicity with which the prior art is concerned, the prior art may quantitatively determine hydrophobicity using as a test or criterion only one or two of these parameters in any given instance. As used herein and in the claims, a web is characterized as having a "substantial hydrophobicity" only where it has a strike-through of over 180 seconds. Such a high strike-through typically (but not necessarily) has associated therewith a hydrohead of at least 5 cm and a contact angle of at least 90°.

As used herein and in the claims, the coined term "condrapability" designates an attribute combining the aesthetic tactile parameters of hand (or handle) and drapability. "Hand" relates to the organoleptic feel of a fabric, typically as the fingers of a hand experience it when the hand is moved parallel over the fabric surface. It is not exactly smoothness because a material such as glass may be very smooth and yet have poor hand. It is not exactly softness because a material such as a polypropylene film may be quite soft and yet have poor hand. On the other hand, "drapability" relates to the ability of a fabric to be folded or crushed. Conveniently hand may be thought of as related to the external or surface friction of a fabric, and drapability may be thought of as related to the internal or fiber-to-fiber friction of the fabric.

The well known Handle-O-Meter test procedure (INDA IST 90.3-95) provides a reliable quantitative measurement of condrapability which correlates well with organoleptic test panel results. It is variously referred to as in the art as a measure of hand, softness, drapability, flexibility and the like. However, in fact, it measures both the hand or external friction effect and the drapability or internal friction effect. The Handle-O-Meter measures the force required to push a fabric through a slot opening with a blade approximately the same length as the opening. A fabric specimen of given dimensions is placed on the instrument platform consisting of two thin metal plates which form a slot 0.25 in. (6.4 mm) in width for webs having a basis weight of 5 to 100 gsm. A centerline (MD or CD) of the fabric specimen is aligned across the slot and/or penetrating blade used to force the specimen into the slot. The force required to do this is measured and reported in grams of force. The test is repeated with the fabric specimen re-oriented 90°. Except where indicated, the results reported are averages of the results with the fabric extending across the slot in the machine direction (MD) and in the cross-machine direction (CD). The tests are normally made on both sides for a two-sided material, but in the present situation the tests were made on one side only since the material was not considered to be two-sided. Variations in structural or formation uniformity affect the Handle-O-Meter test results which should therefore be averages of several (about 10) readings.

The more condrapable the fabric, the more easily it moves through the slot under the influence of the blade. The test results reflect both the drapability of the material (that is, the ease with which it is folded or crushed by the blade to pass through the slot) and the hand of the material (that is, the ease with which the friction generated between the moving fabric and the stationary slot) is overcome. The less force required to push the fabric through the slot, the lower the test reading and the more condrapable the fabric.

The web may comprise a single layer (such as a meltblown layer M or a spunbond layer S), a composite of two layers (such as an SS, MM or SM web), or even a composite of three or more layers (such as an SMS or SMMS web). In an SMS or SMMS web, the outer layers may be selected to provide the desirable hand or feel while the middle layer(s) is selected for particular liquid or gas barrier properties. Accordingly, particular webs may vary greatly in weight (grams per square meter), and this variation in weight will of course have a substantial impact on the drapability of the web and thus the condrapability thereof. Accordingly, in determining condrapability, the Handle-O-Meter test procedure must be modified to have webs of different weight tested using slots of different width, heavier basis weights requiring wider slots, or the test must be conducted for comparative purposes only on webs of comparable weight. Accordingly, as used herein, a web is characterized as having a "substantial improvement in condrapability" only where it has a Handle-O-Meter decrease of at least 15% average for MD and CD relative to the initial condrapability, the slot width being selected appropriately for the weight of the web.

The method of the present invention begins with a hydrophobic nonwoven web of continuous fibers formed by processes well known in the art. Preferably the web is a "meltspun"—that is, a meltblown, spunbond or combination thereof. It is essentially formed of continuous fibers, rather than staple fibers, and thus excludes carded nonwoven webs.

In a preferred embodiment, the fibers are thermoplastic or spinnable polymers selected from the group consisting of polyolefins, polyesters, polyamides, copolymers thereof (with olefins, esters, amides or other monomers) and blends thereof. As used herein the term "blend" includes either a homogeneous mixture of at least two polymers or a nonhomogeneous mixture of at least two physically distinct polymers such as the bicomponent fibers. Preferably the fibers are polyolefins selected from the group consisting of polyethylene, polypropylene, copolymers thereof and blends thereof, including, for example, ethylene/propylene copolymers and polyethylene/polypropylene blends. Optimally the fibers are polypropylene, due to the natural hydrophobicity of such fibers either alone or with minor amounts of the less hydrophobic polyethylene.

The fibers are consolidated into the form of a nonwoven web of continuous fibers by any of a wide variety of processes well known in the art, such as those selected from the group of thermal bonding (fusion bonding), chemical bonding (resin bonding), hydroentanglement and needle punch. The fibers are preferably consolidated by a thermal bonding or similar process which leaves the individual fibers exposed to additives.

The method involves the step of applying to the web a fiber surface-modifying agent dispersed in an aqueous medium. The agent is dispersed in an aqueous medium in order to facilitate the economical application of the agent to the web by any of a variety of processes well known in the art for applying an additive or agent to a web, such as spraying, coating, foaming, pasting, screen printing, or even use of a saturation bath or a double kiss roll with a nip. In a preferred "dip and nip" method of applying the agent to the web, the web is passed through the aqueous solution containing the medium ("the dip") and then through nip rolls ("the nip"), which force the solution into the web interior while removing excess solution from the web surface. To produce drapability, the static fiber-to-fiber friction must be reduced, thereby to enable deformation of the fabric. This requires the agent to not only reside on the surface of the fabric, but also to penetrate into the interstices of the fabric and, in theory, reach the surface of each fiber of the fabric.

The wet pick-up (that is, the pick-up by the web of the aqueous medium, including the agent) is preferably 20% to 200%, based on the dry web. Lower wet pick-up levels tend to produce non-uniformly low levels of the agent being added to the web, while higher web pick-up levels require longer web drying times. The aqueous medium preferably has 0.5% to 20% agent therein, based on the weight of the aqueous medium. Lower levels of the agent in the aqueous medium tend to produce non-uniformly low levels of the agent being added to the web, while higher levels of the agent in the aqueous medium potentially lead to undesirable viscosity changes in the aqueous medium. The dried web preferably has 0.005% to 0.5% agent thereon, based on the weight of the dried web. Lower levels of agent on the dried web are difficult to achieve with tight control of uniformity, while higher levels of agent on the dried web are not only unnecessary and expensive, but may also adversely affect the web hydrophobicity level.

Drying of the agent-bearing web to remove the aqueous medium and leave the condrapable hydrophobic web may be accomplished by conventional means such as a hot air through dryer, steam cans, hot air drum, infrared oven, or the like. The hot air is maintained at an appropriate temperature for the particular web material, typically 110°–125° C. for polypropylene with a 130° C. softening temperature.

As earlier noted, PDMS or polydimethylsiloxane is a well known additive for increasing the hydrophobicity of a web. The PDMS has the formula

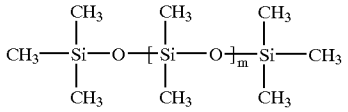

where m=greater than zero.

Typically m is in the range of 400 to 1500, preferably 400–650, thereby to provide a viscosity of 200–1000 centistokes ($mm^2$/sec) at 25° C.

The amino-modification of the present invention is the substitution of an aminoalkyl group for a methyl group. Thus the amino-modified PDMS is

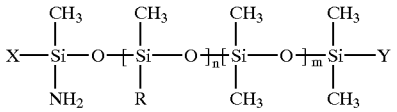

where independently Y, X=a termination group;

$R=R_1—NH—R_2$;

$R_1=—(CH_2)_p—$, where p=greater than zero;

$R_2$=hydrogen, alkyl, cycloalkyl, aryl, aminoalkyl, alkylaminoalkyl, cycloalkylaminoalkyl, or aminoaryl; and independently n, m=greater than zero.

The termination groups useful as Y and X include H, OH, methyl, ethyl, acetyl, methoxy, ethoxy and the like.

$R_1$ is a polymethylene, such as methylene, bimethylene, trimethylene, etc. An especially preferred amino-modification employs trimethylene as $R_1$ and has the following aminopropyl formula:

$$R=CH_2—CH_2—CH_2—NH—R_2.$$

$R_2$ is preferably nonionic and is hydrogen, alkyl, cycloalkyl or aryl, or preferably the amino derivatives thereof (that is, aminoalkyl, alkylaminoalkyl, cycloalkylaminoalkyl or aminoaryl) so as to achieve the additional condrapability afforded by the additional amino group of each amino-modification.

In a preferred amino-modified PDMS, n is 120 to 500 preferably about 150, and together n and m are 400 to 1500 (preferably about 1100). The molecular weight of the amino-modified PDMS, at the time of application to the web, is about 30,000 to 150,000 (preferably 70,000–100,000). Generally speaking, increasing the n/m ratio produces a more condrapable web, albeit a slightly less hydrophobic web than would be the case if the PDMS were not amino-modified. Also generally speaking, increasing the molecular weight of the amino-modified PDMS produces a slight increase in the condrapability of the web, without noticeably decreasing the hydrophobicity of the web. Presumably this is because an increase in the n/m ratio not only increases the number of amino groups in each molecule, but also decreases the relative number of unmodified PDMS groups, while an increase in the molecular weight of the amino-modified PDMS increases the total number of amino groups in each molecule, but does not decrease the relative number unmodified PDMS groups.

The degree of amino-modification is 2 to 5 (preferably about 3.5), and the amino number is 0.1 to 0.3 (preferably 0.12–0.15). The degree of amino-modification represents the fraction of the total methyl groups in the PDMS molecule which are replaced by the amino-modification groups. The amino number represents the milligrams of potassium hydroxide (KOH) equivalent to neutralize one gram of the amino-modified PDMS. Accordingly, both the degree of amino-modification and the amino number are indicative of the number of amino groups being added to the PDMS molecule. It will be appreciated that, as a statistical matter, there will inevitably be traces of unmodified PDMS mixed in with the amino-modified PDMS, but typically less than 1% by weight.

Amino-modified PDMS is available from Schill & Seilacher Aktiengesellschaft of Boeblingen, Germany, under such trade names as SILASTOL SJKN and UKANOL in a macro-emulsified form, wherein the amino-modification is an aminoethyl-aminopropyl group (that is, $R_1$ is propyl and $R_2$ is aminoethyl, an aminoalkyl). Such amino-modified PDMS has been and is used for providing softness for woven textiles, but has generally been supplanted by improved products which enable the woven textiles to become soft and remain more hydrophilic.

As earlier noted, PDMS is highly hydrophobic. Whether used as itself or in an amino-modified form (that is, as the agent of the present invention), it is typically dispersable in an aqueous medium only through the intervention of a hydrophilic emulsifier. A preferred hydrophilic emulsifier is nonionic in form, such as at least one ethoxylated fatty alcohol, and preferably a mixture of ethoxylated fatty alcohols. It may also include a nonionic or cationic co-emulsifier. The hydrophilic emulsifier has an HLB (hydrophobic/lipophilic balance) of 8–17, preferably 10–15, and optimally 13. It is typically used at a level of 3% to 30%, based on the weight of the agent. Naturally the hydrophilic emulsifier is used at a minimum level in order to minimize the hydrophilic effect of the emulsifier addition on the hydrophobic nature of the web. Modified or unmodified PDMS is by itself somewhat more hydrophobic than polypropylene, but when mixed with the hydrophilic emulsifier required to enable it to form an emulsion, it has about the same hydrophobicity as polypropylene.

After the web has been dried to remove the aqueous medium, the remaining web (including the agent and any emulsifier remaining thereon) is characterized by a substantial hydrophobicity, as measured by a strike-through of over 300 seconds, and by a substantial improvement in condrapability, as measured by a Handle-O-Meter decrease of at least 15% average for MD and CD relative to the initial condrapability (and preferably at least 20% average).

Surprisingly, it has been found that a minimum improvement in final condrapability (measured as a percentage of the initial condrapability) results without regard to the initial condrapability level. Thus, not only those webs initially lacking any substantial condrapability, but also those webs initially exhibiting a substantial condrapability, will be caused by the agent to exhibit an improved condrapability.

The product of the present invention is a hydrophobic nonwoven web of continuous fibers having a fiber surface-modifying agent on the fibers to form therewith a condrapable hydrophobic nonwoven web of continuous fibers. The agent essentially comprises the aforementioned amino-modified PDMS, and the condrapable hydrophobic fiber is characterized by a substantial hydrophobicity and by a substantial improvement in condrapability of at least 15%, as aforestated.

The following examples illustrate the efficacy of the present invention.

EXAMPLE I

A fiber surface-modifying agent (SILASTOL SJKN) according to the present invention was dispersed in an aqueous medium (water) at a level of 3%, based on the weight of the water. The agent was applied to a thermal bonded SS nonwoven web of polypropylene (15 gsm) having a bonding area of 19%, using a two kiss roll applicator (one roll on each side of the web) to insure full saturation of the web, and therefore complete moisturizing of the surface of the fibers. The web speed was 250 m/min and the kiss roll speed was 8 rpm. The web was dried with an IR-dryer to the "bone dry" state, then conditioned for 24 hours. The following test results were obtained (the average of 10 specimens);

The dried web contained 0.18% agent, based on the weight of the dried web.

The dried web showed a strike-through time greater than 300 seconds (untreated control: over 300 seconds). The test was stopped at 350 seconds.

The dried web showed a contact angle of 123° (untreated control 128°).

The dried web showed a condrapability (in mN) using the Handle-O-Meter of 9.3 in MD and 4.5 in CD on average (untreated control: 12.3 in MD and 5.5 in CD on average). See TABLE I.

These test results show, in comparison to the untreated control, a condrapable hydrophobic nonwoven web exhibiting a substantial improvement in condrapability of 25% in MD and 19% in CD on average (overall average: 22%).

EXAMPLE II

The procedure of Example I was conducted on a thermal bonded nonwoven SMMS web of polypropylene (15.5 gsm, including 3.5 gsm of meltblown) having a bonding area of 19%.

The dried web contained 0.24% agent, based on the weight of the dried web, and a bonding area of 19%.

The dried web showed a strike-through time greater than 300 seconds (untreated control: over 300 seconds). The test was stopped at 350 seconds.

The dried web showed a contact angle of 124° (untreated control 127°).

The dried web showed a condrapability (mN) using the Handle-O-Meter of over 12.5 MD and 4.9 CD on average (untreated control: 16 MD and 6.6 CD on average). See TABLE I.

These test results show, in comparison to the untreated control, a condrapable hydrophobic nonwoven web exhibiting a substantial improvement in condrapability of 22% MD and 26% CD on average (overall average: 24%).

EXAMPLE III

The procedure of Example I was conducted on a thermal bonded nonwoven SS web of polypropylene (15 gsm) having a bonding area of 17%.

The dried web contained 0.17% agent, based on the weight of the dried web.

The dried web showed a strike-through time greater than 300 seconds (untreated control: over 300 seconds). The test was stopped at 350 seconds.

The dried web showed a contact angle of 123° (untreated control 123°).

The dried web showed a condrapability (mN) using the Handle-O-Meter of over 8.4 MD and 3.6 CD on average (untreated control: 12.6 MD and 5.6 CD on average). See TABLE I.

These test results show, in comparison to the control, a condrapable hydrophobic nonwoven web exhibiting a substantial improvement in condrapability of 33% MD and 35% CD on average (overall average 34%).

EXAMPLE IV

The procedure of Example I was conducted on a thermal bonded nonwoven SMMS web of polypropylene (15.5 gsm, including 3.5 gsm of meltblown) having a bonding area of 17%.

The dried web contained 0.26% agent, based on the weight of the dried web.

The dried web showed a strike-through time greater than 300 seconds (untreated control: over 300 seconds). The test was stopped at 350 seconds.

The dried web showed a contact angle of 122° (untreated control 125°).

The dried web showed a condrapability (mN) using the Handle-O-Meter of over 14.5 MD and 5.4 CD on average (untreated control: 18 MD and 7.7 CD on average). See TABLE I.

These test results show, in comparison to the untreated control, a condrapable hydrophobic nonwoven web exhibiting a substantial improvement in condrapability of 22% MD and 26% CD on average (overall average: 25%).

EXAMPLE V

The procedure of Example I was conducted on a thermal bonded nonwoven SS web of 96/4 weight ratio polypropylene/polyethylene copolymer (15 gsm) having a bonding area of 17%, obtained from Exxon as an experimental resin and similar to the 97/3 ratio copolymer commercially available from Exxon under the trade name ESCORENE PP 9355.

The dried web contained 0.38% agent, based on the weight of the dried web.

The dried web showed a strike-through time of about 300 seconds (untreated control: 240–300 seconds). The test was stopped at 350 seconds.

The dried web showed a contact angle of 121°.

The dried web showed a condrapability (mN) using the Handle-O-Meter of over 4 MD and 1 CD on average (untreated control: 7 MD and 4 CD on average). See TABLE I.

These test results show, in comparison to the untreated control, a condrapable hydrophobic nonwoven web exhibiting a substantial improvement in condrapability of 43% MD and 75% CD on average (overall average: 59%).

EXAMPLE VI

As a treated control, a fiber surface-modifying agent (a macro emulsion of unmodified PDMS available under the trade name SILASTOL E35 from Schill & Seilacher) was dispersed in an aqueous medium (water) at a level of 0.15%, based on the weight of the water. The agent was applied to a laboratory-sized hand sample of a thermal bonded SS nonwoven web of polypropylene (15 gsm) having a bonding area of 19%. A dipping bath (similar to a saturation bath) with a pair of pressure adjustable nip rolls (available under the trade name LABORATORY FOULARD # VFH-35594 from Mathis Company of Germany) was used to insure full saturation of the web, and therefore complete moisturizing of the surface of the fibers. The web speed was 0.5 m/min, and the nip roll pressure was at 50 on a scale of 1–100 units. The web was dried with a laboratory forced-air-oven dryer to the "bone dry" state, then conditioned for 24 hours. The following test results were obtained (the average of 10 specimens):

The dried web had a dry add-on of 0.25% agent, based on the weight of the dried web.

The dried web showed a strike-through time of 185.2 seconds (untreated control: 197.7 seconds).

The dried web showed a contact angle of 130.2° (untreated control 129.2°).

The dried web showed a condrapability (in mN) using the Handle-O-Meter of 9.7 in MD and 4.2 in CD on average (untreated control: 12.4 in MD and 5.5 in CD on average). See TABLE II.

These laboratory test results show, in comparison to the untreated control, a condrapable hydrophobic nonwoven web exhibiting a substantial improvement in condrapability, but a slight decrease in hydrophobicity.

EXAMPLE VII

A fiber surface-modifying agent according to the present invention (a macro emulsion of an amino-modified PDMS available under the trade name SILASTOL SJKN) was dispersed in an aqueous medium (water) at a level of 0.4%, based on the weight of the water. The procedure of Example VI was followed.

The following test results were obtained (the average of 10 specimens):

The dried web had a dry add-on of 0.15% agent, based on the weight of the dried web.

The dried web showed a strike-through time of 231.8 seconds (untreated control: over 197.7 seconds).

The dried web showed a contact angle of 129.6° (untreated control 129.2°).

The dried web showed a condrapability (in mN) using the Handle-O-Meter of 8.4 in MD and 3.5 in CD on average (untreated control: 12.4 in MD and 5.5 in CD on average). See TABLE II.

These laboratory test results show, in comparison to the untreated control, a condrapable hydrophobic nonwoven web exhibiting a more substantial improvement in condrapability than the PDMS treated control and an increase in hydrophobicity.

EXAMPLE VIII

As a treated control, a fiber surface-modifying agent (a macro emulsion of unmodified PDMS available under the trade name SILASTOL E35) was dispersed in an aqueous medium (water) at a level of 0.15%, based on the weight of the water. The agent was applied to a laboratory-sized hand sample of a thermal bonded SMMS nonwoven web of polypropylene (15 gsm) having a bonding area of 19%. The procedure of Example VI was followed.

The following test results were obtained (the average of 10 specimens):

The dried web had a dry add-on of 0.25% agent, based on the weight of the dried web.

The dried web showed a strike-through time of greater than 300 seconds (untreated control: over 300 seconds).

The dried web showed a contact angle of 129.6° (untreated 128.1°).

The dried web showed a condrapability (in mN) using the Handle-O-Meter of 14.9 in MD and 5.1 in CD on average (untreated control: 16 in MD and 6.5 in CD on average). See TABLE II.

These laboratory test results show, in comparison to the untreated control, a condrapable hydrophobic nonwoven web exhibiting an improvement in condrapability without a decrease in hydrophobicity.

EXAMPLE IX

A fiber surface-modifying agent according to the present invention (a macro emulsion of an amino-modified PDMS available under the trade name SILASTOL SJKN) was dispersed in an aqueous medium (water) at a level of 0.4%, based on the weight of the water. The agent was applied to a thermal bonded SMMS nonwoven web of polypropylene (15 gsm) having a bonding area of 19%. The procedure of Example VI was followed.

The following test results were obtained (the average of 10 specimens):

The dried web had a dry add-on of 0.21% agent, based on the weight of the dried web.

The dried web showed a strike-through time greater than 300 seconds (untreated control: over 300 seconds).

The dried web showed a contact angle of 127.9° (untreated control 128.1°).

The dried web showed a condrapability (in mN) using the Handle-O-Meter of 12.8 in MD and 4.3 in CD on average (untreated control: 16 in MD and 6.5 in CD on average). See TABLE II.

These laboratory test results show, in comparison to the untreated control, a condrapable hydrophobic nonwoven web exhibiting a more substantial improvement in condrapability than the PDMS treated control without a decrease in hydrophobicity.

While the copolymer web (of Example V) showed a higher initial condrapability than any of the pure polypropylene webs (of Examples I through IV), it also showed a surprisingly high increase in condrapability (overall average 59% and especially in the CD) relative to the pure polypropylene webs. This may be related to the relatively high add—on level or percentage agent (0.38% relative to 0.17–0.26% of the pure polypropylene webs).

While the treated copolymer web (of Example V) demonstrated borderline "substantial hydrophobicity" as defined according to the present application, the hydrophobicity after treatment remains sufficiently high for many practical applications, especially where condrapability would be of greater significance than hydrophobicity.

Generally a comparison of Examples I–II with Examples III–V indicates an enhanced condrapability effect for the method of the present invention where the bonding area is reduced (for example, to about 17%) relative to a standard bonding area (for example, about 19%). Thus, a bonding area of 12–18% is preferred, optimally 13–17%.

Generally Examples VI–IX show that while unmodified PDMS improves condrapability relative to an untreated control, it may decrease hydrophobicity. On the other hand, amino-modified PDMS improves condrapability more than the unmodified PDMS, while either not significantly decreasing hydrophobicity or actually increasing it.

The materials of the present invention find utility in a wide variety of industrial applications. For example, the materials are useful as filters for air filtration, car filters, liquid filters and filter bags. The materials are also useful in industrial protective clothing such as clean room apparel, commodity consumer clothing, dust protection and chemical protection. The materials are further useful as industrial wipes such as clean room wipes, oil absorption wipes, lens cleaning wipes, and surface protection for low friction and/or non-scratch surfaces. Other industrial applications for the materials include house wrapping, packaging, furniture and bedding, car covers, insulation, insulative electrical cable wrapping, battery separators, shoe components and the like.

The materials are useful as wraps and packaging for both home and industrial usage.

Further, the materials of the present invention find utility in a wide variety of hygiene applications. For example, the materials are useful as backsheets or outer covers, leg cuffs, waistbands, stretch tabs, and elastic or extendable side panels.

Finally, the materials of the present invention also find utility in a wide variety of medical applications. For example, the materials are useful as surgical drapes, surgical gowns, cut-in-place gowns, shoe covers, bouffant caps and sterilization wrapping.

The specification of particular applications hereinabove is to be taken as exemplary only, and not as limiting. Uses other than the aforenoted industrial, hygiene and medical applications follow naturally from the physical and chemical properties of the materials of the present invention.

The materials of the present invention offer high condrapability, high hydrophobicity, low surface-to-surface friction, and high slippage/low stickiness, and thus find particular utility in hygienic applications (especially as backsheets or outer covers, leg cuffs stretch tabs, and elastic or extendable side panels), in the furniture and bedding industry (such as seat covers, spring pockets, and slip covers), in general wrap and packaging applications, and as insulative electrical cable wrapping.

While the present invention has been described hereinabove in the context of a web which was hydrophobic both initially and after treatment, the principles of the present invention apply also to webs which are initially of a hydrophilic nature (i.e., exhibit a strike-through significantly less than 10 seconds, preferably less than 3 seconds) such as the biodegradable polymers PLA (poly (lactic acid)) or PCL (polycaprolactone). Thus if the web is initially hydrophilic, the treated web will be either less hydrophilic or possibly even weakly or moderately hydrophobic. This is because the agent of the present invention to some degree covers the surface of the fibers of the web and thereby masks, conceals or transforms the surface (depending upon how one wishes to view it) so that it is effectively either less hydrophilic or even hydrophobic. As a practical matter, the agent does not cover 100% of the surface of the fibers so that the initial hydrophilicity/hydrophobicity of the fibers cannot be entirely ignored and will influence whether the treated web is only less hydrophilic or actually hydrophobic. For the purposes of the present invention, however, the treated web should have a strike-through of at least 10 seconds.

To summarize, the present invention provides a method of making a condrapable hydrophobic nonwoven web of continuous fibers, using as an additive a fiber surface-modifying agent dispersed in an aqueous medium which retains its essentially hydrophobic nature. The agent may be dispersed in the aqueous medium using a hydrophilic emulsifier in a quantity such that it does not adversely affect the hydrophobic nature of the web add hydrophobic. The present invention also provides a product made by the method.

Now that the preferred embodiments of the present invention have been shown and described in detail, various modifications and improvements thereon will become readily apparent to those skilled in the art. Accordingly, the spirit and scope of the present invention is to be construed broadly, and limited only by the appended claims, and not by the foregoing specification.

TABLE I

| | | CONDRAPABILITY | | | |
|---|---|---|---|---|---|
| Example | | Control, mN | Treated, mN | | Increase In Condrapability., % (ave.) |
| | POLYPROPYLENE | | | | |
| I | SS - Bonding Area* 19% - Add-on 0.18% | | | | |
| | MD | 12.4 | 9.3 | 25 | (22%) |
| | CD | 5.5 | 4.5 | 19 | |
| II | SMMS - Bonding Area* 19% - Add-on 0.24% | | | | |
| | MD | 16.0 | 12.5 | 22 | (24%) |
| | CD | 6.6 | 4.9 | 26 | |
| III | SS - Bonding Area** 17% - Add-on 0.17% | | | | |
| | MD | 12.6 | 8.4 | 33 | (34%) |
| | CD | 5.6 | 3.6 | 35 | |
| IV | SMMS - Bonding Area** 17% - Add-on 0.26% | | | | |
| | MD | 18 | 14.5 | 19 | (25%) |
| | CD | 7.7 | 5.4 | 30 | |
| | PP/PE COPOLYMER | | | | |
| V | SS - Bonding Area** 17% - Add-on 0.38% | | | | |
| | MD | 7 | 4 | 43 | (59%) |
| | CD | 4 | 1 | 75 | |

*Standard bonding area: 19% Add-on: SS: 0.18% SMMS: 0.24%.

TABLE I-continued

| Example | CONDRAPABILITY Control, mN | Treated, mN | Increase In Condrapability., % (ave.) |
|---|---|---|---|

**Reduced bonding area: 17% Add-on: SS: 0.17% SMMS: 0.26% SS Blend: 0.38%

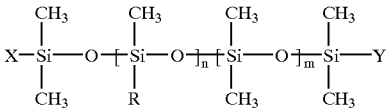

where independently Y, X=a termination group;

$R=R_1—NH—R_2$;

TABLE II

Comparison of Untreated Control vs PDMS vs Amino-modified PDMS

| Example | Product | Dry-Add-on Levels (in percentages) | Strike-Through (in seconds) | Contact Angle (in degrees) | Condrapability (mN) MD | CD |
|---|---|---|---|---|---|---|
| — | 14 gsm SS/control | 0.00% | 197.7 | 129.2 | 12.4 | 5.5 |
| VI | 15 gsm SS/PDMS | 0.25% | 185.2 | 130.2 | 9.7 | 4.2 |
| VII | 15 gsm SS/mod. PDMS | 0.15% | 231.8 | 129.6 | 8.4 | 3.5 |
| — | 15.5 gsm SMMS/control | 0.00% | 300.0 | 128.1 | 16 | 6.5 |
| VIII | 15.5 gsm SMMS/PDMS | 0.25% | 300.0 | 129.6 | 14.9 | 5.1 |
| IX | 15.5 gsm SMMS.mod. PDMS | 0.21% | 300.0 | 127.9 | 12.8 | 4.3 |

We claim:

1. A method of making a condrapable hydrophobic nonwoven web of continuous fibers, comprising the steps of:

(A) providing a hydrophobic nonwoven web of continuous fibers having an initial condrapability;

(B) applying to the web a fiber surface-modifying agent dispersed in an aqueous medium, the agent consisting essentially of an amino-modified polydimethylsiloxane; and (C) drying the web to remove the aqueous medium and leave a condrapable hydrophobic web.

2. A method of making a condrapable hydrophobic nonwoven web of continuous fibers, comprising the steps of:

(A) providing a hydrophobic nonwoven web of continuous fibers having an initial condrapability;

(B) applying to the web a fiber surface-modifying agent dispersed in an aqueous medium, the agent comprising an amino-modified polydimethylsiloxane; and (C) drying the web to remove the aqueous medium and leave a condrapable hydrophobic web;

the agent being dispersed in the aqueous medium by a hydrophilic emulsifier.

3. A method of making a condrapable hydrophobic nonwoven web of continuous fibers, comprising the steps of:

(A) providing a hydrophobic nonwoven web of continuous fibers having an initial condrapability;

(B) applying to the web a fiber surface-modifying agent dispersed in an aqueous medium, the agent comprising an amino-modified polydimethylsiloxane; and (C) drying the web to remove the aqueous medium and leave a condrapable hydrophobic web;

the amino-modification being the substitution of an aminoalkyl group for a methyl group.

4. The method of claim 3 wherein the amino-modified PDMS is $R_1$=—$(CR_2)_p$— where p=greater than zero;

$R_2$=hydrogen, alkyl, cycloalkyl, aryl, aminoalkyl, alkylaminoalkyl, cycloalkylaminoalkyl, or aminoaryl; and independently n, m=greater than zero.

5. The method of claim 4 wherein:

$R=CH_2—CH_2—CH_2—NH—R_2$.

6. The method of claim 5 wherein $R_2$ is an aminoalkyl.

7. The method of claim 6 wherein R is aminoethylaminopropyl.

8. The method of claim 4 wherein:

(A) n=120 to 500; and n+m=400 to 1,500;

(B) the degree of amino modification is 2 to 5; and (C) the amino number is 0.1 to 0.3.

9. The method of claim 8 wherein:

(D) n=about 150; and n+m=is about 1,100;

(E) the degree of amino modification is about 3.5; and (F) the amino number is about 0.12–0.15.

10. The method of claim 4 wherein the molecular weight of the amino-modified PDMS is about 30,000 to 150,000.

11. The method of claim 10 where the molecular weight of the amino-modified PDMS is about 70,000 to 100,000.

12. A method of making a condrapable hydrophobic nonwoven web of continuous fibers, comprising the steps of:

(A) providing a hydrophobic nonwoven web of continuous fibers having an initial condrapability;

(B) applying to the web a fiber surface-modifying agent dispersed in an aqueous medium, the agent comprising an amino-modified polydimethylsiloxane; and (C) drying the web to remove the aqueous medium and leave a condrapable hydrophobic web;

the wet pick-up of the web being 20 to 200%, based on the dry web.

13. The method of claim 12 wherein the aqueous medium has 0.5 to 20% agent therein, based on the weight of the aqueous medium.

14. A method of making a condrapable hydrophobic nonwoven web of continuous fibers, comprising the steps of:

(A) providing a hydrophobic nonwoven web of continuous fibers having an initial condrapability;

(B) applying to the web a fiber surface-modifying agent dispersed in an aqueous medium, the agent comprising an amino-modified polydimethylsiloxane; and (C) drying the web to remove the aqueous medium and leave a condrapable hydrophobic web;

the dried web having 0.005 to 0.5% agent thereon, based on the weight of the dried web.

15. The method of claim 1 wherein the fibers are selected from the group consisting of polyolefins, polyesters, polyamides, copolymers thereof and blends thereof.

16. The method of claim 15 wherein the fibers are polyolefins selected from the group consisting of polyethylene, polypropylene, copolymers thereof and blends thereof.

17. The method of claim 16 wherein the fibers are polypropylene.

18. A method of making a condrapable hydrophobic nonwoven web of continuous fibers, comprising the steps of:

(A) providing a hydrophobic nonwoven web of continuous fibers having an initial condrapability;

(B) applying to the web a fiber surface-modifying agent dispersed in an aqueous medium, the agent comprising an amino-modified polydimethylsiloxane; and (C) drying the web to remove the aqueous medium and leave a condrapable hydrophobic web;

the fibers being blends of polypropylene/polyethylene copolymer containing about 4% polyethylene.

19. The method of claim 1 wherein the web is a meltspun nonwoven.

20. The method of claim 1 wherein the fibers are consolidated by a process selected from the group consisting of thermal bonding, chemical bonding, hydroentanglement and needle punch.

21. The method of claim 20 wherein the fibers are consolidated by a thermal bonding process.

22. A method of making a condrapable hydrophobic nonwoven web of continuous fibers, comprising the steps of:

(A) providing a hydrophobic nonwoven web of continuous fibers having an initial condrapability;

(B) applying to the web a fiber surface-modifying agent dispersed in an aqueous medium, the agent comprising an amino-modified polydimethylsiloxane; and (C) drying the web to remove the aqueous medium and leave a condrapable hydrophobic web;

the web having a bonding area of about 12–18% based on the total area of the web.

23. The method of claim 2 wherein the hydrophilic emulsifier is nonionic.

24. The method of claim 23 wherein the hydrophilic emulsifier is at least one ethoxylated fatty alcohol.

25. The method of claim 23 wherein the hydrophilic emulsifier includes a nonionic or cationic co-emulsifier.

26. The method of claim 23 wherein the hydrophilic emulsifier has an HLB of 8 to 17.

27. The method of claim 23 wherein the hydrophilic emulsifier is present at 3 to 30%, based on the weight of the agent.

28. A method of making a condrapable hydrophobic nonwoven web of continuous fibers, comprising the steps of:

(A) providing a hydrophobic nonwoven web of continuous fibers having an initial condrapability;

(B) applying to the web a fiber surface-modifying agent dispersed in an aqueous medium, the agent comprising an amino-modified polydimethylsiloxane; and (C) drying the web to remove the aqueous medium and leave a condrapable hydrophobic web;

the dried web being characterized by a substantial hydrophobicity, as measured by a strike-through of over 180 seconds, and by a substantial improvement in condrapability, as measured by a Handle-O-Meter decrease of at least 15% average for MD and CD relative to the initial condrapability.

29. The method of claim 28 wherein the decrease is at least 20% average for MD and CD.

30. A method of making a condrapable hydrophobic nonwoven web of continuous fibers, comprising the steps of:

(A) providing a hydrophobic nonwoven web of continuous fibers having an initial condrapability;

(B) applying to the web a fiber surface-modifying agent dispersed in an aqueous medium; and (C) drying the web to remove the aqueous medium and leave a dried web characterized by a substantial hydrophobicity, as measured by a strike-through of at least 180 seconds, and by a substantial improvement in condrapability, as measured by a Handle-O-Meter decrease of at least 15% average for MD and CD relative to the initial condrapability.

31. The method of claim 30 wherein the agent is dispersed in the aqueous medium by a hydrophilic emulsifier.

32. The method of claim 30 wherein the agent essentially comprises an amino-modified polydimethylsiloxane and the amino-modification is the substitution of an aminoalkyl group for a methyl group.

33. The method of claim 32 wherein the amino-modified PDMS is

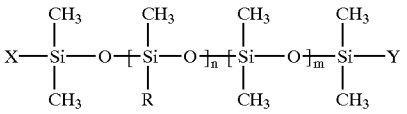

where independently Y, X=a termination group;

$R=R_1—NH—R_2$;

$R_1=—(CH_2)_p—$ where p=greater than zero;

$R_2$=hydrogen, alkyl, cycloalkyl, aryl, aminoalkyl, alkylaminoalkyl, cycloalkylaminoalkyl, or aminoaryl; and independently n, m=greater than zero.

34. The method of claim 33 wherein:

$R=CH_2—CH_2—CH_2—NH—R_2$.

35. The method of claim 34 wherein $R_2$ is an aminoalkyl.

36. The method of claim 35 wherein R is aminoethylaminopropyl.

37. The method of claim 33 wherein:

(D) n=120 to 500; and n+m=400 to 1,500;

(E) the degree of amino modification is 2 to 5; and (F) the amino number is 0.1 to 0.3.

38. The method of claim 37 wherein:

(G) n=about 150; and n+m =is about 1,100;

(H) the degree of amino modification is about 3.5; and (I) the amino number is about 0.12–0.15.

39. The method of claim 33 wherein the molecular weight of the amino-modified PDMS is about 30,000 to 150,000.

40. The method of claim 39 where the molecular weight of the amino-modified PDMS is about 70,000 to 100,000.

41. The method of claim 30 wherein the wet pick-up of the web is 20 to 200%, based on the dry web.

42. The method of claim 41 wherein the aqueous medium has 0.5 to 20% agent therein, based on the weight of the aqueous medium.

43. The method of claim 30 wherein the dried web has 0.005 to 0.5% agent thereon, based on the weight of the dried web.

44. The method of claim 30 wherein the fibers are selected from the group consisting of polyolefins, polyesters, polyamides, copolymers thereof and blends thereof.

45. The method of claim 44 wherein the fibers are polyolefins selected from the group consisting of polyethylene, polypropylene, copolymers thereof and blends thereof.

46. The method of claim 45 wherein the fibers are polypropylene.

47. The method of claim 45 wherein the fibers are polypropylene/polyethylene copolymer containing about 4% polyethylene.

48. The method of claim 30 wherein the web is a meltspun nonwoven.

49. The method of claim 30 wherein the fibers are consolidated by a process selected from the group consisting of thermal bonding, chemical bonding, hydroentanglement and needle punch.

50. The method of claim 49 wherein the fibers are consolidated by a thermal bonding process.

51. The method of claim 30 wherein the web has a bonding area of about 12–18% based on the total area of the web.

52. The method of claim 31 wherein the hydrophilic emulsifier is nonionic.

53. The method of claim 52 wherein the hydrophilic emulsifier is at least one ethoxylated fatty alcohol.

54. The method of claim 52 wherein the hydrophilic emulsifier includes a nonionic or cationic co-emulsifier.

55. The method of claim 52 wherein the hydrophilic emulsifier has an HLB of 8 to 17.

56. The method of claim 52 wherein the hydrophilic emulsifier is 3 to 30%, based on the weight of the agent.

57. The method of claim 30 wherein the decrease is at least 20% average for MD and CD.

58. A method of making a condrapable nonwoven web of continuous fibers, comprising the steps of:

(A) providing a hydrophilic nonwoven web of continuous fibers having an initial condrapability;

(B) applying to the web a fiber surface-modifying agent dispersed in an aqueous medium, the agent essentially comprising an amino-modified polydimethylsiloxane; and (C) drying the web to remove the aqueous medium and leave a condrapable web of reduced hydrophilicity.

59. A method of making a condrapable hydrophobic nonwoven web of continuous fibers, comprising the steps of:

(A) providing a non-hydrophobic nonwoven web of continuous fibers having an initial condrapability;

(B) applying to the web a fiber surface-modifying agent dispersed in an aqueous medium; and (C) drying the web to remove the aqueous medium and leave a dried web characterized by a substantial hydrophobicity, as measured by a strike-through of at least 180 seconds, and by a substantial improvement in condrapability, as measured by a Handle-O-Meter decrease of at least 15% average for MD and CD relative to the initial condrapability.

60. A method of making a condrapable nonwoven web of continuous fibers, comprising the steps of:

(A) providing a nonwoven web of continuous fibers having an initial condrapability;

(B) applying to the web a fiber surface-modifying agent dispersed in an aqueous medium; and (C) drying the web to remove the aqueous medium and leave a dried web characterized by a hydrophilicity, as measured by a strike-through of at least 10 seconds, and by a substantial improvement in condrapability, as measured by a Handle-O-Meter decrease of at least 15% average for MD and CD relative to the initial condrapability.

* * * * *

UNITED STATES PATENT AND TRADEMARK OFFICE

CERTIFICATE OF CORRECTION

PATENT NO. : 6,632,385 B2
DATED : October 14, 2004
INVENTOR(S) : Kauschke et al.

It is certified that error appears in the above-identified patent and that said Letters Patent is hereby corrected as shown below:

Title page,
Item [73], Assignee, change to -- First Quality Nonwovens, Inc., State College, PA (US) and Schill & Seilacher Aktiengesellschaft, Boeblingen (DE) --.

Signed and Sealed this

Thirty-first Day of May, 2005

JON W. DUDAS
*Director of the United States Patent and Trademark Office*